US010539393B2

(12) United States Patent
Surdu et al.

(10) Patent No.: US 10,539,393 B2
(45) Date of Patent: Jan. 21, 2020

(54) SYSTEM AND METHOD FOR SHOOTING SIMULATION

(71) Applicant: Cole Engineering Services, Inc., Orlando, FL (US)

(72) Inventors: John Surdu, Severn, MD (US); Josh Crow, Orlando, FL (US); Chris Ferrer, Orlando, FL (US); Rick Noriega, Longwood, FL (US); Peggy Hughley, Winter Springs, FL (US); Padraic Baker, Orlando, FL (US)

(73) Assignee: Cole Engineering Services, Inc., Orlando, FL (US)

( * ) Notice: Subject to any disclaimer, the term of this patent is extended or adjusted under 35 U.S.C. 154(b) by 0 days.

(21) Appl. No.: 16/390,189

(22) Filed: Apr. 22, 2019

(65) Prior Publication Data

US 2019/0249955 A1 Aug. 15, 2019

Related U.S. Application Data

(63) Continuation of application No. 15/141,114, filed on Apr. 28, 2016, now Pat. No. 10,309,751.

(51) Int. Cl.

| | |
|---|---|
| ***F41G 3/26*** | (2006.01) |
| ***F41A 33/00*** | (2006.01) |
| *F41J 5/10* | (2006.01) |

(52) U.S. Cl.
CPC ..... *F41G 3/2605* (2013.01); *F41A 33/00* (2013.01); *F41J 5/10* (2013.01)

(58) Field of Classification Search
CPC ..... G09B 9/003; F41A 33/00; F41A 33/02; F41A 33/04; F41A 33/06
See application file for complete search history.

(56) References Cited

U.S. PATENT DOCUMENTS

2007/0190494 A1* 8/2007 Rosenberg ..... A63F 13/12 434/11
2014/0178841 A1* 6/2014 Carter ..... F41A 33/00 434/19

* cited by examiner

*Primary Examiner* — Timothy A Musselman
(74) *Attorney, Agent, or Firm* — Christopher M. Ramsey; GrayRobinson, P.A.

(57) ABSTRACT

A shooting simulation system and method for training personnel in targeting visual and non-line-of-sight targets. The firearm simulation system has a plurality of participants each having a firearm and each being equipped to transmit their location to a remote computer server for storage and use with other transmitted data to determine which participant was a Shooter and which participant was the Shooter's target and for determining a simulated hit or miss of the target and assessing the simulated damage to the target.

20 Claims, 4 Drawing Sheets

SYSTEM AND METHOD FOR SHOOTING SIMULATION

CROSS-REFERENCE TO RELATED APPLICATIONS

This a continuation of application Ser. No. 15/141,114, filed Apr. 28, 2016. This prior application is incorporated by reference in its entirety.

STATEMENT REGARDING FEDERALLY SPONSORED RESEARCH OR DEVELOPMENT

This invention was made with government support under contract no. W911QX-13-C-0026 awarded by the United States Army—Army Contracting Command (ACC) Aberdeen Proving Ground (APG). The government has certain rights in the invention.

FIELD OF THE INVENTION

The invention relates to a shooting simulation system and method for training personnel in targeting visual and non-line of sight targets.

BACKGROUND OF THE INVENTION

Military, security, and law enforcement personnel conduct training in order to experience and learn from mistakes prior to a "real world" event. Small arms and vehicle marksmanship training involves a mix of techniques, including firing live ammunition on a firearm range. An important training technique is live, force-on-force training. In such training, participants in a field environment employ tactics and their full range of firearm systems against each other. An important component of such training is proper employment of the trainees' firearms while reinforcing proper tactics, techniques, and procedures.

Current state of the art employs laser emitters on the Shooters' firearms and laser sensors on the targets. An exemplar system of this type is the Multiple Integrated Laser Engagement System, or MILES. In laser engagement systems an emitter mounted on the firearm generates a laser signal when the firearm's trigger is pulled and a blank cartridge creates the appropriate acoustic, flash, and/or shock signature. These types of laser engagement systems suffer many drawbacks that collectively provide "negative training", that is training that results in incorrect results or behaviors. The present invention addresses each of these drawbacks.

The first major drawback to laser engagement systems is that they cannot be used to engage partially occluded targets, such as a target that is partially hidden behind a bush. Terrain features that would not stop an actual projectile block lasers. There is evidence that in exercises involving laser engagement systems participants incorrectly learn to take cover behind terrain that would not stop a bullet, resulting in higher casualties in their initial firefights. Similarly, obscurants, such as smoke or fog, may block a laser, stopping participants from successfully engaging legitimate targets.

Proper marksmanship techniques involve aiming slightly ahead of or leading a moving target. The second major drawback of laser engagement systems is that participants are penalized for leading moving targets. Lasers travel in a straight line and are nearly instantaneous. When engaging a moving target with a laser engagement system, participants must—incorrectly—aim at the target, not ahead of it. This is another source of negative training.

Bullets travel in a parabolic trajectory, not a straight line. The sights of firearms are aligned with the barrel of the firearm so that the path of the bullet intersects the line of sight at specified distances, such as 25 and 250 meters, based on how the weapon is bore sighted. At different ranges the bullet's trajectory may be above or below the line of sight so that when firing at shorter ranges the Shooter may have to aim below the center of mass of the target and at longer ranges the Shooter may have to aim above the center of mass. With laser engagement systems, employing these proper marksmanship techniques often results in incorrect misses being recorded, which is yet another source of negative training.

Laser engagement systems project a beam from the emitter toward the target, where one or more detectors worn by the target sense the beam. The beam has a wider diameter as it travels farther due to diffraction. This results in anomalous situations. At short ranges, the beam may be so small that it does not trigger any detectors even though the beam strikes the center of mass of the target. At longer distances, the beam may be so wide that it triggers a detector even though the center of the beam is far from the intended target. Again, these phenomena result in negative training.

Lasers travel in a straight line. This makes laser engagement systems incapable of representing high-trajectory, or non-line of sight, firearms, such as grenade launchers and rifle grenades. As these firearms often represent a significant percent of a military unit's firepower, the inability to simulate them has a negative impact on training. Small unit leaders do not have the opportunity to train to employ these firearms as part of their actions in contact with an enemy and the operators of those firearms do not get a chance to employ them as part of a tactical situation.

Lasers are instantaneous. Armed forces often employ relatively slow moving weapons like anti-tank guided missiles (ATGMs) whose time of flight between the Shooter and the target can be a few seconds. With these systems, it is important for the Shooter to maintain his sight picture of the target throughout the time of flight. Since lasers strike the target almost instantaneously with the pull of the trigger, these slower weapons are not represented realistically in live, force-on-force training.

Finally, laser engagement systems rely on a laser signal striking detectors. Participants who want to win the training event often go to some length to obscure or cover the detectors. A solution that does not rely on a signal striking a detector would be advantageous.

State of the art for mixed and augmented reality technologies has proven insufficient to address live, force-on-force training, largely because they rely on very precise tracking of the participants' locations and the orientations of their firearms. Current tracking technologies used to estimate participant and firearm location and orientation are insufficient to support long-range direct fire. Tracking solutions developed for augmented reality (AR) only support engagements at ranges of approximately 50 meters, but military personnel are trained to fire at targets at 375 meters.

Techniques have been proposed that involve active emitters on the targets to make them easier to sense; however, many military, security, and law-enforcement personnel wear night vision devices. An emitter that is visible in night vision devices is another source of negative training as it may make targets unrealistically easy to detect in the environment.

Other techniques have been proposed which rely on indicia to properly identify targets and compute hits and misses. Techniques involving indicia suffer from many of the same drawbacks as laser engagement systems, namely that they do not enable non-line of sight engagements and they do not permit firing through obscurants and terrain features like bushes and tall grass.

A technology that addresses the shortcomings of laser engagement systems would be advantageous to military, security, and law enforcement professionals and might even be applied to entertainment uses. A solution that permits firing through obscurants and fire at partially occluded targets would improve live, force-on-force training. A solution that takes into account the ballistic characteristics of the simulated projectile with respect to the projectiles trajectory as well as time of flight would enable participants to properly elevate their firearm based on the range to the target and to lead moving targets. If such a system also permitted high-trajectory or non-line of sight fire, that would be advantageous. It would also be advantageous for a system to require no indicia, emitter, or beacons. Finally such a system should enable accurate credit for a hit or miss out to realistic ranges, based on the firearm system being simulated.

Shooting simulation systems may be seen in the Carter U.S. Pat. Nos. 8,888,491 and 8,459,997 and 8,678,824. These patents teach an optical recognition system for simulated shooting using a plurality of firearms with each firearm held by a separate player. Each player has a computer and an optical system associated with the firearm for capturing an image. The image provides information on a trajectory of a simulated bullet fired from a shooting firearm and is used to determine a hit or miss of the targeted player. Each player is wearing some type of indicia such as color codes, bar codes, helmet shape for identification which does not allow non-line of sight engagements and does not permit firing through obscurants and terrain features like bushes and tall grass.

The Sargent U.S. Pat. No. 8,794,967 is for a firearm training system for actual and virtual moving targets. A firearm has a trigger initiated image capturing device mounted thereon and has a processor and a display. The Lagettie et al. U.S. Patent Application Publication No. 2011/0207089 is for a firearm training system which uses a simulated virtual environment. The system includes a firearm having a scope and a tracking system and a display and a processor.

SUMMARY OF THE INVENTION

A firearm simulation system has a plurality of participants each having a firearm capable of use with direct and non-line of sight shooting. The Shooter can be a person with a direct fire small arm, such as a rifle or submachine gun or with an indirect fire or high-trajectory firearm, such as a grenade launcher or an unmanned system, or an unmanned ground vehicle or unmanned aerial vehicle. The simulation system includes a plurality of firearms, each firearm having a trigger sensor and one firearm being held by each of a plurality of participants in the simulation. Each participant carries a computer and a position location sensor for determining his location, orientation and movement information. Each firearm has an orientation sensor for recording the orientation of the firearm with respect to a known three-dimensional coordinate system, and has an optical system aligned to the sights of the firearm for capturing the sight picture at the time the trigger sensor is activated to provide image information about the aim point of the Shooter participant's firearm with respect to an intended target participant. A remote computer server has an entity server database and a target resolution module. The remote computer server is wirelessly coupled to each participant to periodically receive and store each participant's position location, orientation and speed information in the server entity state database. The stored data is then used by the remote computer server receiving the captured image and the orientation of the Shooter participant's firearm at the time the trigger sensor is activated for use by the computer server target resolution module for identifying the target participant. The computer server stores reported information on each of a plurality of participants' location, orientation and speed and remotely determines the identification of the target participant of the Shooter participant upon activation of the Shooter Participant's trigger sensor.

A method of simulating firearm use between a plurality of participants includes equipping each of a plurality of participants with a firearm having a trigger sensor and an orientation sensor for recording the orientation of the firearm with respect to a known three-dimensional coordinate system, and an optical system aligned to the sights of the firearm for capturing the sight picture at the time the trigger sensor is activated to provide image information about the aim point of the Shooter participant's firearm with respect to an intended target participant. Equipping each of the plurality of participants with a computer and a position location sensor for determining the location, orientation and movement information of the participant. A remote server is selected having an entity state database and a target resolution module and periodically communicates and stores each participant's location, orientation and movement information to the remote server's entity state database. The captured image and the orientation of the Shooter participant's firearm is received at the remote server at the time the trigger sensor is activated in the computer server. The remote computer server determines which participant is a Shooter participant, which activating a firearm's trigger sensor and which participant is the target participant of the Shooter participant with the remote computer server target resolution module using information stored in the entity state database and the received captured image and the orientation of the Shooter participant's firearm. The remote computer server stores the reported periodic information on each of a plurality of participant's location, orientation and movement for computing the remote identification of a target participant of a Shooter participant.

BRIEF DESCRIPTION OF THE DRAWINGS

The accompanying drawings, which are included to provide further understanding of the invention are incorporated in and constitute a part of the specification, and illustrate an embodiment of the invention and together with the description serve to explain the principles of the invention.

DESCRIPTION OF THE INVENTION

The present invention is a system for simulating live, force-on-force simulated firearms engagements at realistic ranges. The Shooter can be a person with a direct fire small arm, such as a rifle or submachine gun or with an indirect fire or high-trajectory firearm, such as a grenade launcher, or an unmanned ground vehicle or unmanned aerial vehicle. The invention simulates a plurality of firearms. The system is symmetrical and homogenous in that a Shooter can also be a target, and vice versa.

Figure 1:
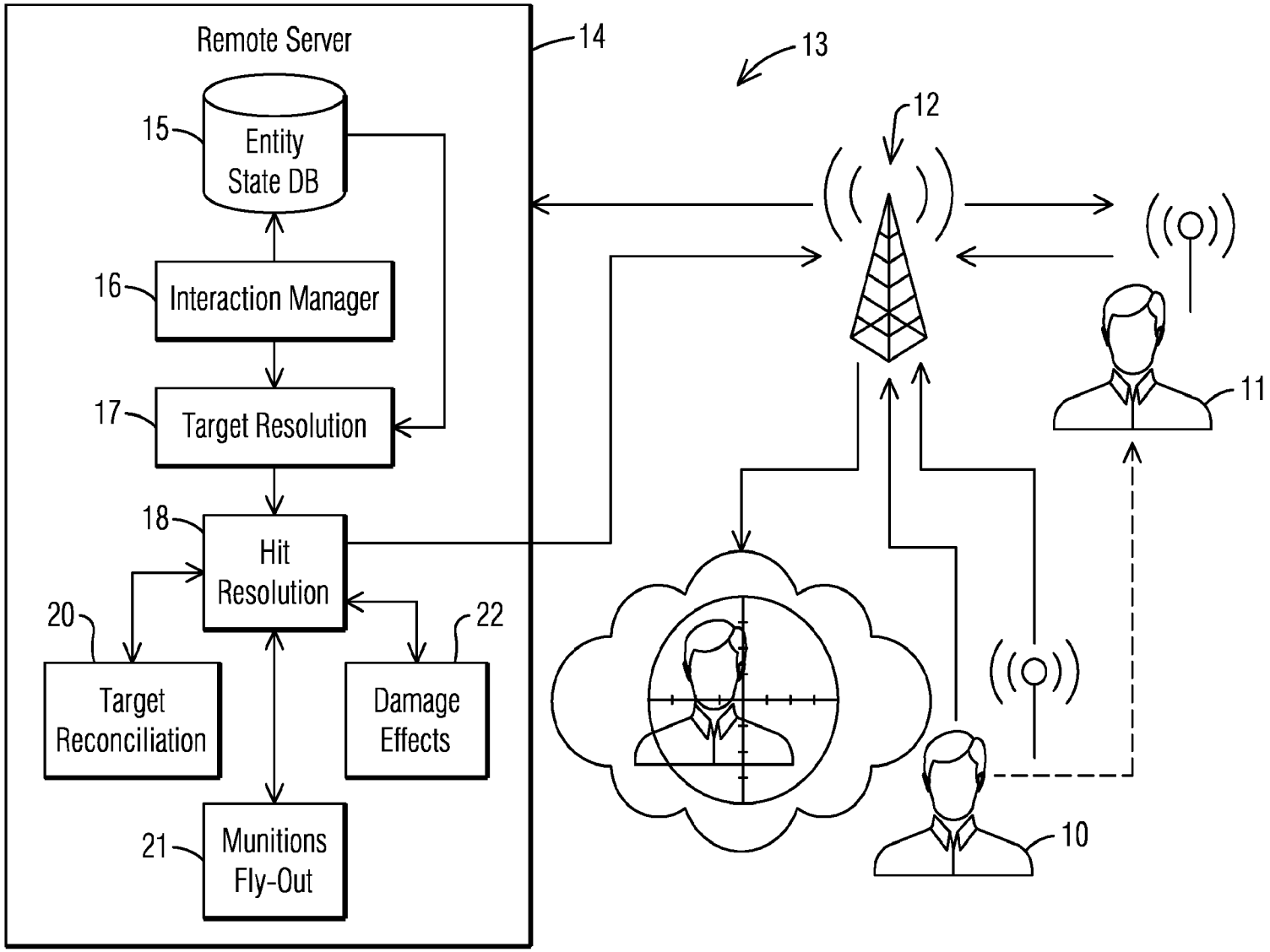
FIG. 1 is a schematic diagram of the overall system architecture of the present invention.
Figure 2:
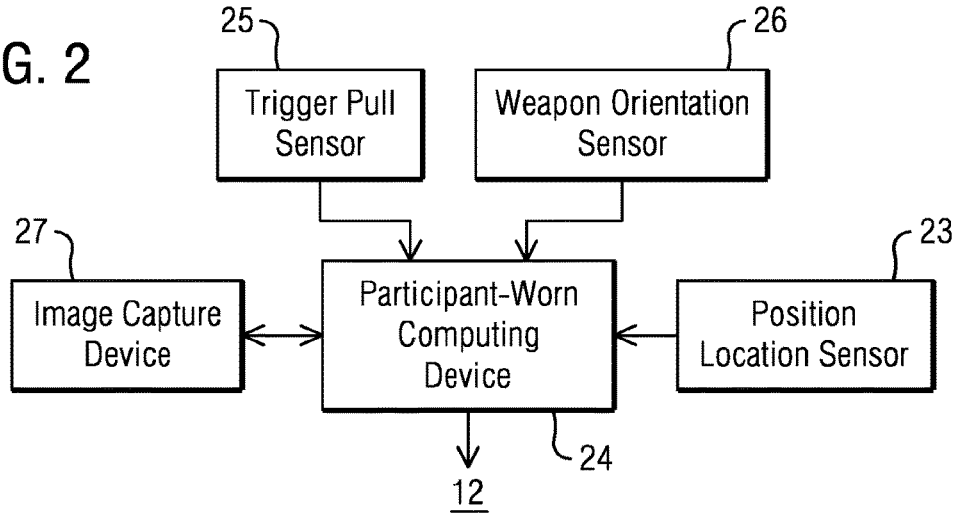
FIG. 2 is diagrammatic view of a participant-worn subsystem.

In FIG. 1 the Shooter 10 and the Target 11 may be reversed. Both the Shooter 10 and Target 11 participants periodically report their estimated location, orientation, and speed to a wireless communication relay 12. These location updates are transmitted 13 to a Remote Server 14, where they are stored in the Entity State Database 15 for later use. The wireless communication relay uses transceivers located in the remote server and in each participant's computer. Though FIGS. 1 and 2 depict a rifle, this invention is not limited to a rifle, but rather supports a plurality of firearms.

The Shooter 10 aims his firearm at his Target 11 and pulls the trigger which activates a trigger sensor. The Shooter's location, firearm orientation, and sight image are transmitted to the wireless relay. The sight image is a digital representation of the Shooter's view through his firearm's sight when he pulls the trigger. The location and orientation of the Shooter 10 and his sight image are transmitted to the Remote Server 14 and to the Interaction Manager 16. The Interaction Manager queries the target Resolution Module 17, which produce a list of possible targets from the Entity State Database based on the firearm location, orientation, known position sensor error, and known orientation sensor error. This list of possible targets is provided to the Hit Resolution Module 18.

The Hit Resolution Module 18 runs the multiple, multi-spectral algorithms to find targets in the sight image. Multiple algorithms may be used based on environmental conditions and other factors that influence which algorithms will be the most successful. This step includes processing the sight image to locate targets and determining the relationship between the aim point and the target based on the sight image. For instance, did the Shooter aim high, low, left, or right of center of mass of the target.

The Hit Resolution Module 18 calls the Target Reconciliation Module 20, which reconciles results from the computer vision computation with information from the Entity State Database. This step identifies which targets from the Target Resolution Module 20 correspond to targets identified by the computer vision algorithm. This step is purely based on the results of employing a plurality of computer vision (CV) algorithms and does not rely on any artificial indicia in the scene. The CV algorithms use a plurality of algorithms to construct a silhouette around the target; however, if the CV algorithms cannot construct a full silhouette, they then construct a bounding box around the targets in the scene.

The Hit Resolution Module 18 queries the Munitions Fly-out Module 21 for the flight time of the projectile and adjustments to the trajectory of the round. These adjustments can be based on range (e.g., drop of the round over distance), atmospheric effects, weather, wind, interactions with the terrain, and other factors as required to accurately predict the trajectory of the round. The system uses a representation of the terrain in the area of interest to compute whether the simulated projectile struck the target.

The Hit Resolution Module 18 computes whether the trajectory of the round intersects the target determined by the Target Reconciliation Module 17 based on the adjusted trajectory, time of flight, and relative velocity of the target. Relative velocity accounts for movement of the target, the Shooter, and the Shooter's firearm. If the round strikes the projected target location at time of impact, the Hit Resolution Module 18 calls the Damage Effects Module 22. This module computes the damage to the target based on the firearms characteristics, the munitions characteristics, and location of the calculated impact point in the target's calculated silhouette. Damage effects indicate the extent of damage to the target, such as whether the target was killed, sustained a minor wound or major wound, the location of the wound, and the like.

A near miss is reported through the wireless relay 12 and retransmitted to the Target 11 and the Shooter 10, respectively, who are informed of the near-miss results via audio and visual effects similar to the existing MILES system. A hit result is reported through the wireless relay 12 and re-transmitted to the Target 11 and the Shooter 10, respectively. The Shooter is notified of a hit, and the Target is notified that he was hit, with what firearm or round he was hit, and the severity of the damage.

FIG. 2 displays the configuration of the firearm subsystem. The Position Location Sensor 23, which incorporates a GPS system, provides periodic updates of the participant's location, orientation, and speed to the Participant-Worn Computing Device 24. The Participant-Worn Computing Device transmits these updates to the wireless relay 12.

When the participant pulls the trigger on his training rifle, the Trigger Pull Sensor 25 sends a message to the Participant-Worn Computing Device 24. The Participant-Worn Computing Device 24 captures the trigger-pull events. The Firearm Orientation Sensor 26 returns the firearm orientation to the Participant-Worn Computing Device 24. Similarly, the Image Capture Device 27 provides the sight image as seen by the Shooter 10 to the Participant-Worn Computing Device. The Image Capture Device 27 may provide:

1. A mix of visible spectrum, non-visible spectrum, and multi-spectral images.
2. A video image or a series of still images.
3. Images from a single viewpoint or multiple viewpoints.
4. Images from narrow and wide-angle viewpoints.

The Participant-Worn Computing Device 24 sends the location and orientation of the firearm as well as the sight images via the Wireless Relay 12 to the Remote Server 14.

The target is not augmented with indicia or beacons. Other than the participant-worn subsystem, the target includes only his operational equipment.

Figure 3A:
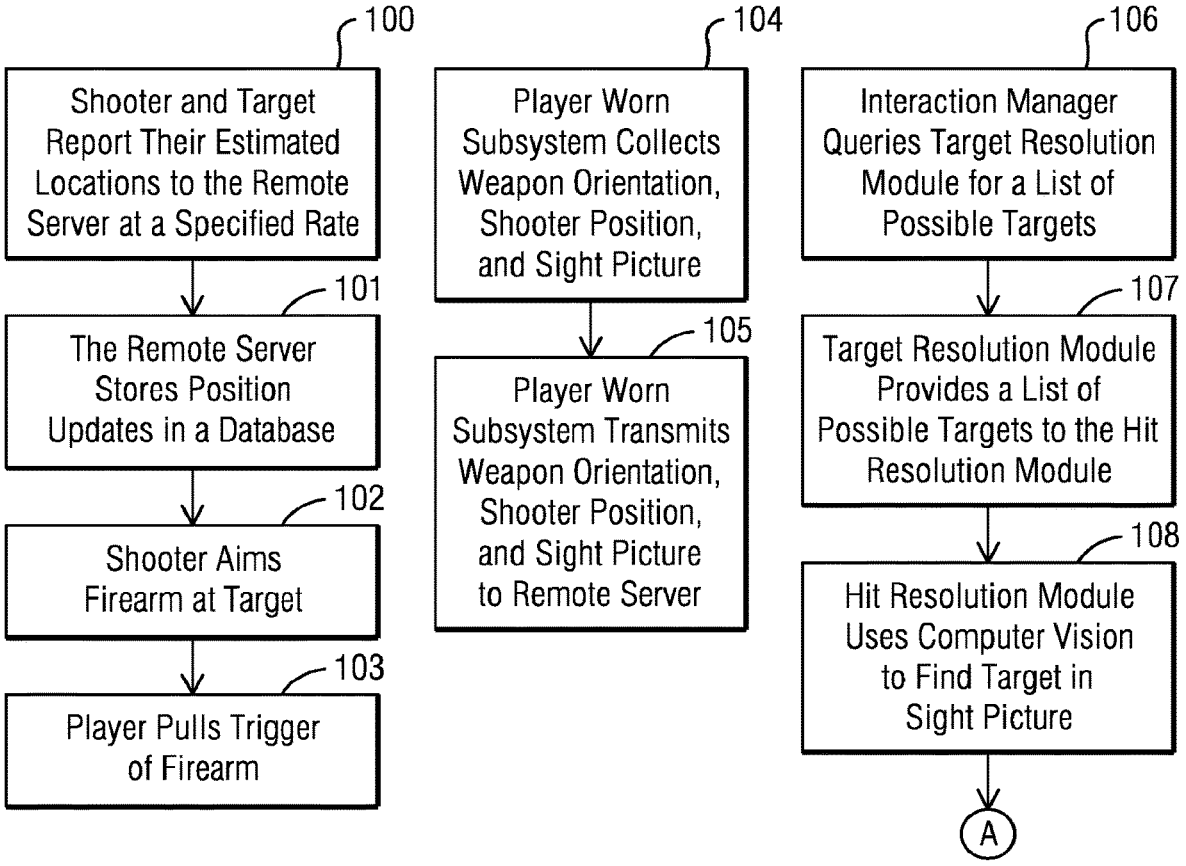
FIGS. 3A and 3B are flow charts illustrating the steps used by the system to determine whether a Shooter hits the target.

In FIG. 1 the Shooter is indicated as 10, and the Target is 11; however, in this approach the roles may be reversed. As shown in FIG. 3A, Step 100, both the Shooter 10 and Target 11 periodically report their estimated location, orientation, and speed to a wireless communication relay 12.

The Orientation Sensor 26 provides three-dimensional orientation with respect to the geomagnetic frame of reference. This three-dimensional representation can be in the form of a quaternion; yaw, pitch, and roll; or other frame of reference, as appropriate. The Orientation Sensor 26 is calibrated to the fixed coordinate system when the system is turned on, and it can be periodically recalibrated during a simulation event as necessary. The orientation sensor may employ a plurality of methods to determine three-dimensional orientation. There is no minimum accuracy requirement for the Orientation Sensor 26; although, a more accurate orientation sensor reduces the burden on the Target Reconciliation Module 17.

The Location Sensor 23 provides the Shooter's location with respect to a fixed reference frame. In the current embodiment, this is provided as latitude and longitude, but other coordinate representation methods may be employed. The participant's speeds may be measured directly by the position sensor or may be inferred through the collection of several position reports over time.

The location, orientation, and velocity updates are transmitted 13 to a Remote Server 14, where they are stored in the Entity State Database 15 for later use, as shown in FIG. 3A, Step 101. These updates occur at sufficient rapidity that the Remote Server can accurately estimate each Participant's velocity.

As depicted in FIG. 3A, Steps 102 and 103, the Shooter 10 aims his firearm at his Target 11 and pulls the trigger. The event of the trigger being pulled can be sensed electronically to complete a circuit for sending a message to the Participant-Worn Computer 24, or the trigger sensor 25 can be activated by a combination of acoustic, flash, and shock signatures. As depicted in FIG. 3A, Step 104, when the participant pulls the trigger on his firearm, the Trigger Pull Sensor 25 sends a message to the Participant-Worn Computing Device 24. The Participant-Worn Computing Device 24 sends the trigger-pull events to the Remote computer Service 14. The Firearm Orientation Sensor 26 returns the firearm orientation to the Participant-Worn Computing Device 24. Similarly, the Image Capture Device 27 provides the sight image as seen by the Shooter to the Participant-Worn Computing Device 24.

As shown in FIG. 2, the participant-worn subsystem includes an Orientation Sensor 26 on the firearm, an Image Capture Device 27 on the firearm, and a Position Location Sensor 23. The Orientation Sensor 26 and Image Capture Device 27 may be collocated or mounted separately. The Trigger Pull Sensor 25, Position Location Sensor 23, Orientation Sensor 24, and Image Capture Device 27 may be connected to the Participant-Worn Computing Device 24 though a cable or wireless radio link.

The sight image is a digital representation of the Shooter's view through his firearm's sight when he pulls the trigger. The image capture device 27 is aligned with the barrel and sights of the simulated firearm so that the image captured from the device is an accurate representation of the Shooter's sight picture when the trigger was pulled. In the first embodiment of the invention, the image capture device 27 is the same scope through which the Shooter is aiming the firearm, but the image capture device may be separate form the weapon sights. The image capture device 27 may provide:

- A mix of visible spectrum, non-visible spectrum, and multi-spectral images;
- A video image or a series of still images; Images from a single viewpoint or multiple viewpoints; and
- Images from narrow and wide-angle viewpoints.

The Position Location Sensor 23 provides periodic updates of the participant's location, orientation, and speed to the Participant-Worn Computing Device 24. The Participant-Worn Computing Device transmits these updates to the wireless relay 12.

FIG. 3A, Step 105, the Participant-Worn Computing Device 24 transmits the Shooter's location, firearm orientation, and sight image to the wireless relay 12. This Wireless Relay may be any communications means with sufficient bandwidth to process the information, depending on the number of simultaneous participants. The Wireless Relay may be incorporated into the Participant-Worn Computing Device 24 or it may be a separate radio linked to the Participant-Worn Computer 24 through a cable or other wireless link.

The location and orientation of the Shooter 10 and his sight image are transmitted from the Wireless relay 12 to the Remote Server 14 and the Interaction Manager 16. Any communication means with sufficient bandwidth may be used in this step of the process. The Participant-Worn Computing Device 24 may perform preprocessing of the captured sight picture to reduce bandwidth requirements. Pre-processing includes, but is not limited to, cropping the image, reducing the resolution of the image, compressing the image, and/or adjusting the tint, hue, saturation, or other attributes of the image.

In FIG. 3A, Step 106, the Interaction Manager queries the Target Resolution Module 17 for a list of possible targets. In FIG. 3A, Step 107, The Target Resolution Module 17 produces a list of possible targets from the Entity State Database 15 based on the firearm location, orientation, known position sensor error, and known orientation sensor error. Target resolution is the first step in the hit detection pipeline. The Target Resolution algorithm uses Shooter position, target positions previously reported and stored in the Entity State Database 15, and the field of view of the Image Capture Device to determine which targets, if any, may be present in the sight picture. The determination is based on whether the target is alive or dead and whether the target's reported position lies within a cone built using the known position and orientation errors of the sensors. If no living target candidates are within field of view of the Image Capture Device 27, the Interaction Manager 16 records the shot as a miss due to the lack of targets and no further processing is done.

The Target Resolution Module 17 provides this list of possible targets to the Hit Resolution Module 18. In FIG. 3A, Step 108, the Hit Resolution Module 18 employs a plurality of computer vision (CV) algorithms to find targets in the captured sight image. Multiple algorithms may be used based on environmental conditions and other factors that influence which algorithms will be the most successful.

Figure 3B:
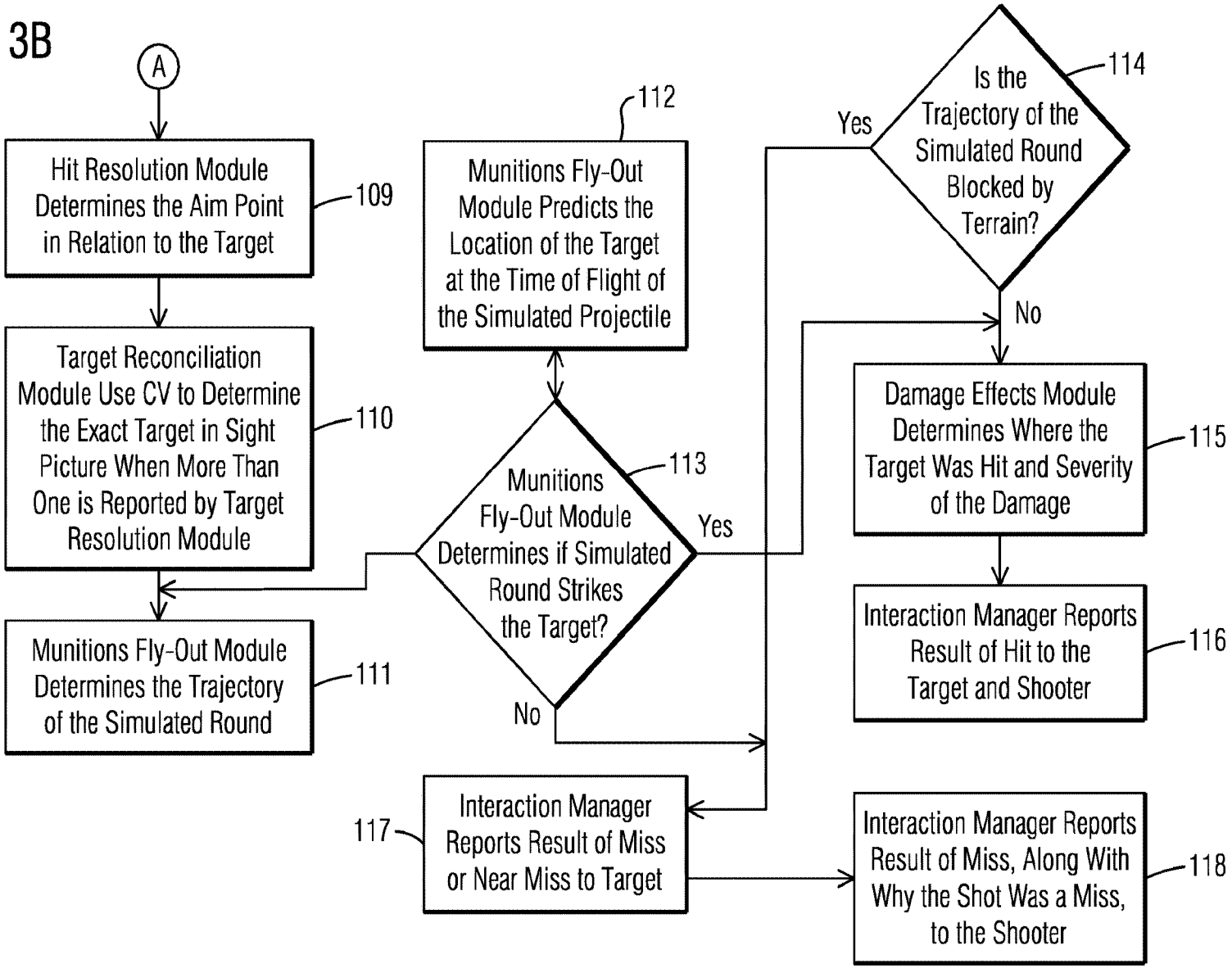

In FIG. 3B, Step 109, the Hit Resolution Module 18 processes the sight image to locate targets and determining the relationship between the aim point and the target based on the sight image. For instance, did the Shooter aim high, low, left, or right of center of mass of the target. The Hit Resolution Module 18 identifies target silhouettes in the scene. Where targets are partially occluded, the Hit Resolution Module 18 "fills in" the occluded portion of the target using an appropriate image processing technique, taking into account the target's posture and speed. If the CV algorithms cannot construct a full silhouette, it then instead constructs a bounding box around the targets in the scene.

In FIG. 3B, Step 110, the Target Reconciliation Module 20 reconciles results from the computer vision computation with information from the Entity State Database 15. The Hit Resolution Module 18 is responsible for identifying human targets within the sight picture and matching them to potential targets from the list generated by the Target Resolution Module 20. This step identifies which targets from the Target Resolution Module 20 correspond to targets identified by the computer vision algorithm. This step is purely based on the results of employing a plurality of computer vision (CV) algorithms as well as heuristics and does not rely on any artificial indicia in the scene.

Having determined the intended target, in FIG. 3B, Step 111, the Hit Resolution Module 18 queries the Munitions Fly-out Module 21 for the flight time of the projectile and adjustments to the trajectory of the round. Flight time of the projectile is based on the distance between the Target and the Shooter. This step uses the reported locations of the Target and Shooter that are stored in the Entity State Database 15. Adjustments to the trajectory of the round can be based on range (e.g., drop of the round over distance), atmospheric effects, weather, wind, interactions with the terrain, and other factors as required to accurately predict the trajectory of the round. The Hit Resolution Module 18 employs the Munitions Fly-Out Module 21 to compute whether the trajectory of the round intersects the target determined by the Target Reconciliation Module 20 based on the adjusted trajectory, time of flight, and velocity of the target. While at very short ranges, small arms fire may be simulated as instantaneous, for distance targets and slower weapons, such as anti-tank guided missiles (ATGMs), predicting where the round impacts targets based on adjusted trajectory, distance between the Shooter and Target, time of flight of the munition, and atmospheric conditions is critical to realistic simulation of these engagements. In addition, the Hit Resolution Module 18 accounts for the minimum arming distance of some munitions, such as grenades, mortars, and anti-tank rockets that must travel a certain distance before the fuse arms and the round may detonate.

In FIG. 3B, Step 112 when a Shooter fires at a moving target, the relative velocity of the target stored in the Entity State Database 15 is used to predict the location of the target at the time of flight of the simulated projectile. Relative velocity accounts for movement of the target, the Shooter, and the Shooter's firearm. In FIG. 3B, Step 113, if the trajectory of the round intersects with the projected position of the target silhouette of the target at the time of impact of the simulated projectile, a possible hit is scored.

In FIG. 3B, Step 114, the system uses a representation of the terrain in the area of interest to compute whether the simulated projectile struck the target. This terrain representation includes the undulations of the ground, vegetation, trees, and other features necessary for this computation. If the trajectory of the round passes through terrain, the Hit Resolution Module 18 determines whether the bullet could pass through the terrain. For instance, a bullet may not pass through sufficient amounts of dirt or sufficiently thick trees; however, a bullet may pass through a hay bale or bush. The Target Resolution Module 20 computed the full silhouette for partially occluded targets. As the Munitions Fly-Out Module 21 is computing the trajectory of the simulated projectile, if the projectile encounters an obstacle through which the projectile may not pass, the Interaction Module 16 records a miss. On the other hand, the Munitions Fly-Out Module 21 computes the trajectory of the simulated projectile, if the projectile encounters an obstacle through which the projectile can pass, the Munitions Fly-Out Module 21 continues to compute the trajectory of the projectile. In this way, the invention can compute a hit on a portion of a target that is partially occluded by terrain that cannot stop a bullet.

The Munitions Fly-Out Module 21 accounts for weapon systems that detonate based on range to the target, distance from the firearm, or other factors, by determining when the detonation occurs. As an example, but not a limitation of the invention, if a Shooter fires simulated munitions from his firearm that explode at a pre-sent distance, the Munitions Fly-Out Module 21 computes the trajectory of the munitions to their points of detonation. The locations where the munitions detonated are then passed to the Damage Effects Module 22 to compute damage to any nearby participants.

In FIG. 3B, Step 115, if the round struck the target, the Hit Resolution Module 18 calls the Damage Effects Module 22. The Damage Effects Module 22 computes the location where the simulated projectile struck the target. Using this location computation, the Damage Effects Module 22 computes the damage to the target based on the firearm's characteristics, munitions characteristics, and location of the impact point in the projected target silhouette at the time of impact. Example results include whether the target was killed, sustained a minor wound or major wound, and the type of wound.

In FIG. 3B, Step 116, a hit result is reported through the wireless relay 12 and retransmitted to the target 11 and the Shooter 10, respectively. The Shooter 10 is notified of a hit, and the Target 11 is notified that he was hit, with what firearm or round he was hit, and the severity of the damage. This information is available on his Participant-Worn computing device 24. This information may stimulate additional training. For instance, a medic might approach the target and read information about the wound on a display so that he can employ the most appropriate first aid techniques.

In FIG. 3B, Steps 117 and 118, a near miss is reported through the wireless relay 12 and retransmitted to the Target 11 and the Shooter 10, respectively, who are informed of the near-miss results on their Participant-Worn Computing Devices 24. For training purposes this information may be recorded for later analysis and use or may be presented in situ to the participants. A miss is not generally reported unless there would be a signature of the shot that the participant could see, such as the blast from a grenade. The reporting of hits and misses can be configured based on different training situations. For instance in one training mode, the system sends feedback to the Shooter 10 after each shot so that the Shooter 10 may learn from each shot and improve his marksmanship. In another training mode, such as simulating a firefight, this constant feedback from the system to the Shooter 10 may be both distracting and inappropriate. In such a situation, the messages to the Shooter 10 may be suppressed during the event and reported afterward.

The system records information from the Remote Server 14 to assist in reviewing the training event. Information such as, but not limited to, participant's locations over time, sight pictures when triggers were pulled, sight pictures after the CV algorithms have processed them, results from the Target Reconciliation Module 20, and status of participant-worn devices may be displayed to an event controller during and after the training event.

Figure 4:
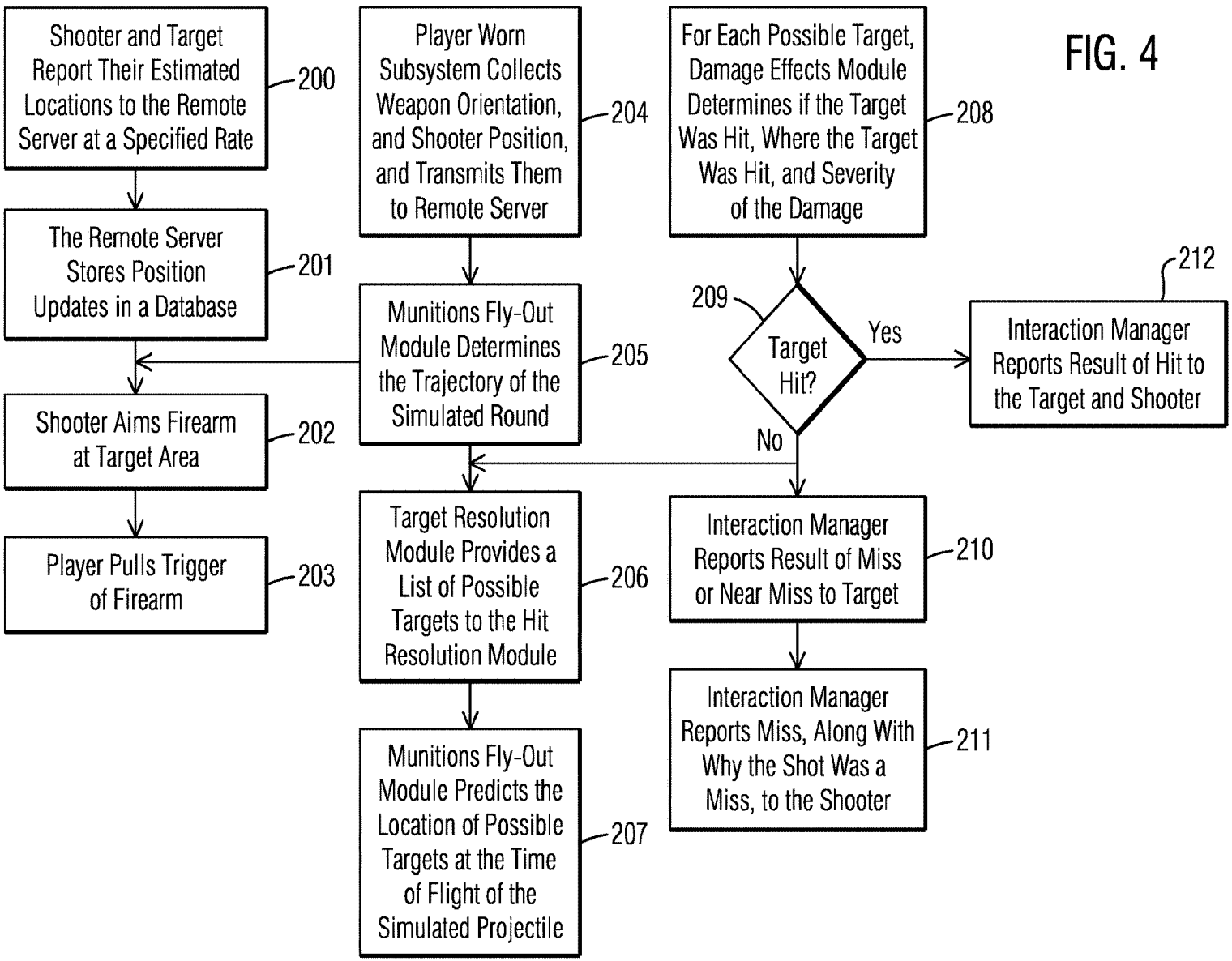
FIG. 4 is a flow diagram of the process of the system for high-trajectory or non-line of sight shots.

This invention is equally applicable to high-trajectory or non-line of sight shooting. In the case of high-trajectory fire, the image from the Image Capture Device 27 is not necessary. The modified process for non-line of sight and high-trajectory shooting is depicted in FIG. 4. Steps 200-203 are exactly the same as Steps 100-103 in FIG. 3A. For high-trajectory fire, a camera bore sighted with the barrel of the weapon is unlikely to see the target, so no sight picture is collected and transmitted. Instead, as shown in FIG. 4, Step 204, the location of the Shooter 10 and the orientation of his weapon is transmitted to the remote server 14. The Munitions Fly-Out Module 21 computes the trajectory of the simulated projectile in Step 205. This computation accounts for the characteristics of the munitions, environmental effects, velocity of the Shooter and his weapon, and the terrain database to determine the point of impact or detonation of the munitions. This computation does not benefit from the sight picture as for direct-fire engagements, so its accuracy is solely dependent on the accuracy of the Position Location Sensor 23 and Weapon Orientation Sensor 26.

In Step 206, the Target Resolution Module 17 queries the Entity State Database 15 to determine whether any participants, friendly or enemy, are within the burst radius of the simulated munitions. In Step 207, the Munitions Fly-Out Module 21 predicts the locations of those participants at the time of impact or detonation of the simulated munitions. In Step 208, for each participant within the burst radius of the munitions, the Damage Effects Module 22 determines if the participant is hit, where the target was hit, and the severity of the damage, just as described in Step 115, FIG. 3B.

In Step 209, if a participant received a hit from a high-trajectory shot, in Step 212, the target is notified of the results, including location(s) and severity of wounds. The Shooter 10 may be notified that he has hit his target as well. In an augmented reality situation, this notification might come in the form of a depiction of an explosion near the target(s). If the high-trajectory shot is a miss or near miss, in Step 210, this is reported to the target. The Shooter 10 may also be notified in Step 211. The reporting of hits and misses can be configured based on different training situations. For instance in one training mode, the system sends feedback to the Shooter 10 after each shot so that the Shooter may learn from each shot and improve his marksmanship. In another training mode, such as simulating a firefight, this constant feedback from the system to the Shooter 10 may be both distracting and inappropriate. In such a situation, the messages to the Shooter 10 may be suppressed during the event and reported afterward.

It should be clear at this time that a shooting simulation system for personnel, unmanned systems, and vehicles has been provided that enables non-line of sight engagements and permits firing through obscurants and terrain features like bushes and tall grass. However the present invention is not to be considered limited to the forms shown which are to be considered illustrative rather than restrictive.

What is claimed is:

1. A shooting simulation method comprising a shooter having a weapon and a position location sensor, a target having a position location sensor, the position location sensors reporting the shooter's location and target's location to a remote computer system, the remote computer system:

receiving (a) a captured image from an optical system on the weapon once the shooter activates a trigger of the weapon, the captured image indicating where the weapon is being aimed when fired, and (b) an orientation of the shooter's weapon when fired;

identifying the target by determining whether the target's location sensor reports that the target is in a line of fire of the weapon and determining whether the target is in the captured image;

calculating a trajectory of a simulated round fired from the weapon based (a) on the captured image and the orientation of the shooter's weapon when the weapon is fired and (b) characteristics of the simulated round; and determining whether the simulated round hit the target.

2. The method of claim 1, wherein the computer system employs a computer vision algorithm to identify a particular target in the captured image when multiple targets are in the line of fire of the weapon.

3. The method of claim 1, wherein determining whether the simulated round hit the target includes calculating whether the simulated round hit the target based on the target's speed and direction of movement.

4. The method of claim 1, wherein determining whether the simulated round hit the target includes determining whether the trajectory of the simulated round is blocked by an obstacle.

5. The method of claim 4, wherein, if the trajectory of the simulated round is blocked by an obstacle, determining whether the simulated round can pass through the obstacle based on characteristics of the obstacle.

6. The method of claim 1, wherein when the target is occluded by an obstacle in the captured image, the remote computer system fills in the occluded portion of the target.

7. The method of claim 1, wherein determining whether the simulated round hit the target includes determining a minimum arming distance of the simulated round.

8. The method of claim 1, wherein the simulated round is at least one round selected from the group bullet, grenade, mortar, and rocket.

9. A shooting simulation system comprising a shooter having a weapon and a position location sensor, a target having a position location sensor, the position location sensors reporting the shooter's location and target's location to a remote computer system, the remote computer system being configured to:

receive (a) a captured image from an optical system on the weapon once the shooter activates a trigger of the weapon, the captured image indicating where the weapon is being aimed when fired, and (b) an orientation of the shooter's weapon when fired;

identify the target by determining whether the target's location sensor reports that the target is in a line of fire of the weapon and determine whether the target is in the captured image;

calculate a trajectory of a simulated round fired from the weapon based (a) on the captured image and the orientation of the shooter's weapon when the weapon is fired and (b) characteristics of the simulated round; and determine whether the simulated round hit the target.

10. The system of claim 9, wherein the computer system employs a computer vision algorithm to identify a particular target in the captured image when multiple targets are in the line of fire of the weapon.

11. The system of claim 9, wherein the computer system determines whether the simulated round hit the target by calculating whether the simulated round hit the target based on the target's speed and direction of movement.

12. The system of claim 9, wherein the computer system determines whether the simulated round hit the target by determining whether the trajectory of the simulated round is blocked by an obstacle.

13. The system of claim 12, wherein, if the trajectory of the simulated round is blocked by an obstacle, the computer system is further configured to determine whether the simulated round can pass through the obstacle based on characteristics of the obstacle.

14. The system of claim 9, wherein, when the target is occluded by an obstacle in the captured image, the computer system can fill in the occluded portion of the target.

15. The system of claim 9, wherein the computer system determines whether the simulated round hit the target by determining a minimum arming distance of the simulated round.

16. The system of claim 9, wherein the simulated round is at least one round selected from the group bullet, grenade, mortar, and rocket.

17. A shooting simulation system comprising:

a plurality of participants respectively carrying a weapon with a trigger sensor, the participants having a computer and a position location sensor that reports the participant's location, orientation and movement information wirelessly to a remote computer system;

an orientation sensor on the participants' firearms that reports an orientation of the respective firearm to the remote computer system;

an optical system aligned with an aim point of the participants' firearms that captures an image of the aim point of a shooter participant's firearm at the time the trigger sensor is activated and provides image information to the remote computer system;

the remote computer system storing each participant's location;

the remote computer system being configured to receive the image and the orientation of the shooter participant's firearm at the time the trigger sensor is activated; and the remote computer system being operable to identify a target participant in the image and to determine the relationship between the point of aim and the target participant's location within the image based on the target participant's location;

wherein when the target participant is occluded by an obstacle in the image, the remote computer system fills in the occluded portion of the target participant.

18. The system of claim 17, wherein the remote computer system determines whether simulated round hit the target participant by determining a minimum arming distance of the simulated round.

19. The system of claim 17, wherein the remote computer system determines whether a simulated round hit the target participant by calculating whether the simulated round hit the target participant based on the target participant's speed and direction of movement and a trajectory of the simulated round.

20. The system of claim 17, wherein the remote computer system determines whether the simulated round hit the target participant by determining whether a trajectory of the simulated round is blocked by an obstacle, the computer system being configured to determine whether the simulated round can pass through the obstacle based on characteristics of the obstacle.

* * * * *